US006476338B2

(12) United States Patent
Shioiri et al.

(10) Patent No.: US 6,476,338 B2
(45) Date of Patent: Nov. 5, 2002

(54) VACUUM SWITCH

(75) Inventors: Tetsu Shioiri, Saitama-ken (JP); Kunio Yokokura, Tokyo (JP); Iwao Ohshima, Kanagawa-ken (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/778,888

(22) Filed: Feb. 8, 2001

(65) Prior Publication Data

US 2001/0035397 A1 Nov. 1, 2001

(30) Foreign Application Priority Data

Feb. 8, 2000 (JP) ..... 2000-029971

(51) Int. Cl.[7] ..... H01H 33/66

(52) U.S. Cl. ..... 218/118; 218/123; 218/130; 218/134

(58) Field of Search ..... 218/118, 123–126, 218/51–53, 120, 139, 140, 154, 134, 136

(56) References Cited

U.S. PATENT DOCUMENTS

| | | | | |
|---|---|---|---|---|
| 4,424,427 A | | 1/1984 | Gebel et al. | 200/144 |
| 5,438,174 A | * | 8/1995 | Slade | 218/118 |
| 5,500,499 A | * | 3/1996 | Seki | 218/130 |
| 5,510,592 A | * | 4/1996 | Gentsch | 218/134 |
| 5,594,224 A | * | 1/1997 | Tanimizu | 218/134 |

FOREIGN PATENT DOCUMENTS

| | | |
|---|---|---|
| DE | 199 36 147 A1 | 2/2001 |
| EP | 0 911 847 A1 | 4/1999 |
| EP | 1 005 058 A2 | 5/2000 |
| EP | 1 005 058 A3 | 7/2001 |
| EP | 1 124 240 A3 | 8/2001 |
| JP | 60-195825 | 10/1985 |
| JP | 61-10816 | 1/1986 |
| JP | 10-210615 | 8/1998 |

* cited by examiner

*Primary Examiner*—Elvin Enad
*Assistant Examiner*—Marina Fishman
(74) *Attorney, Agent, or Firm*—Finnegan, Henderson, Farabow, Garrett & Dunner, L.L.P.

(57) ABSTRACT

A third electrode (8A) is soldered, via a support fitting (9) onto the inner surface of a support part (1*a*) which projects into the intermediate part of the inner surface of an insulation tube (1A). An arc generated between the fixed-side contact (5A) and the movable-side contact (5B) when the switch is opened is led from the outer periphery of the fixed-side contact (5A) via the third electrode (8A) to the movable-side contact (5B), in a so-called two-point switch, and the dielectric breakdown probability is thus reduced, particularly at low voltages.

The third electrode may have its outer periphery exposed from the insulation tube and be used as one electrode when conditioning is carried out.

By the use of this structure, the present invention is capable of meeting the demands for environmental protection and insulation reliability.

6 Claims, 10 Drawing Sheets

VACUUM SWITCH

FIELD OF THE INVENTION

The present invention relates to a vacuum switch.

DESCRIPTION OF RELATED ART

22/33 kV and 66/77 kV grade special high-voltage transformers of the prior art have involved the problems of construction costs caused by the high cost of the necessary land, of insulation and safety problems when the charging parts become soiled and with noise when the switch is operated. Accordingly there has been progress with the size reduction and sealing of the switches and air-insulated switches have been replaced by gas-insulation-type gas-insulated switchgeares and cubicle-type gas-insulated switchgeares.

In the former type of gas-insulated switchgear. the interrupters, disconnecting switches and conductors connected to these are contained in a sealed metal tubular container and this tubular container is filled at high pressure with sulfur hexafluoride ($SF_6$) gas as an insulating gas to achieve size reduction and sealing.

By contrast, the latter type, the cubicle-type gas-insulated switchgear, has been developed to have higher reliability, safety and ease of maintenance and inspection than the former gas-insulated switchgear, together with reducing the space required for installation, shortening construction time and meeting the demand for harmony with the environment surrounding the site of installation.

Thus, in the cubicle-type gas-insulated switchgear, all the electrical devices described above and connections and conductors are contained within a case that is filled with insulating gas at slightly greater than atmospheric pressure, and the interior is divided into gas zones for each circuit, which facilitates maintenance after installation.

Cubicle-type gas-insulated switchgears, which in their external appearance are very similar to the atmosphere-insulated metal enclosure switchgear formerly installed, have come into use to meet contemporary requirements, as described above.

FIG. 1 shows a right-side view (without the right-side plate) of one example of a cubicle-type gas-insulated switchgear, in this case a load-receiving board.

In FIG. 1, front door 14A is attached to the front surface of case 13, the external periphery of which is encased so as to be air-tight by mild steel sheet.

Within case 13, U-shaped partition 15A is welded at its top edges to the ceiling of the case, vertical partition 15B is attached in an air-tight manner somewhat forward of the center of partition 15A and bus-bar partition 15C, which is formed in an L shape, is attached in an air-tight manner to the back of vertical partition 15B.

As a result of this, a U-shaped air insulation cubicle 13*a* is formed in front of, behind and below partition 15A, interrupter cubicle 13*b* is formed in front of partition 15B, an L-shaped load-receiver cubicle 13*c* is formed between the bottom of partition 15B and partition 15A and a small busbar cubicle 13*d* is formed above load-receiver cubicle 13*c*.

Interrupter cubicle 13*b,* load-receiver cubicle 13*c* and bus-bar cubicle 13*d* are filled with $SF_6$ gas 25, as described above.

A vacuum interrupter 16, with a vacuum valve as the switch part, is housed in interrupter cubicle 13*b* and operating mechanism part 17, which is fitted with a wheel and which operates the switch part of vacuum interrupter 16, is housed at the bottom of this vacuum interrupter 16 so as to be capable of being extracted into air-insulated cubicle 13*a*.

Disconnecting switch operating mechanism 22 is attached to the front surface of partition 15A at the front of vacuum interrupter 16 and an operating rod (not shown), which projects to the rear from this disconnecting switch operating mechanism 22, passes through partition 15B, at the rear of interrupter cubicle 13*b,* so as to be air-tight.

Insulating spacers 19A (upper) and 19B (lower) are fitted through partition 15B. The front end of the upper insulating spacer 19A is connected by connecting conductor 18A, covered by a shield tube, to the upper terminal of vacuum interrupter 16 and the front end of lower insulating spacer 19B is connected by a short connecting conductor to the bottom terminal of vacuum interrupter 16.

In bus-bar cubicle 13*d,* disconnecting switch 20 is fixed to the base board, the terminal of the fixed side of disconnecting switch 20 is connected to the back of the insulating spacer 19A, in front of it, and the rear end of an operating rod (not shown), which projects rearward from disconnecting switch operating mechanism 22, as described above, is linked to the top end of lever 20*a* which stands at the rear of the disconnecting switch 20.

The movable side terminal shown at the front of the top end of lever 20*a* of disconnecting switch 20 is connected by a connecting conductor to the bottom end of insulating bushing 21 which passes vertically through a thick attachment sheet welded to the ceiling sheet of bus-bar cubicle 13*d*.

The top end of voltage-detecting insulator 23 is fixed to the rear lower surface of the base sheet of bus-bar cubicle 13*d* and the rear end of connecting conductor 18B, covered by a shield tube, is connected to the terminal at the lower end of voltage-detecting insulator 23 and the front end of connecting conductor 18B is connected to the rear part terminal of lower insulating spacer 19B, in front of it.

The front end of the short connecting conductor 18C, covered with a shield tube, is connected to the rear of the terminal at the bottom end of the voltage-detecting insulator 23 and the rear end of connecting conductor 18C is connected to the front end of cable head 26 which is fitted so as to pass through from the rear of the rear end of partition 15A.

The front end of cable head 26 is again connected to the bottom terminal of arrester 24 which is fitted so as to pass through the ceiling sheet of load-receiving cubicle 13*c* from above.

The top end of high-pressure cross-linked polyethylene cable 27 brought up from a pit formed, as indicated by the broken line, in the floor fitted to the case 13, is connected to the underneath of the cable head 26 and the high-pressure cross-linked polyethylene cable 27 passes through a current transformer 28 fixed to the case.

The connection part of the top of the insulation bushing 21 that is fitted through the ceiling plate of case 13, is connected, via a high-pressure cross-linked polyethylene cable (not shown) to the connection part of the top of an insulation bushing fitted through the ceiling plate of the load-receiving board (not shown) of another system fitted next to box 13.

In a load-receiving board configured in this way as a cubicle-type gas-insulated switchgear, the power fed to the load-receiving board from the exterior disconnecting switch (not shown) fitted in this transformer, via the high-pressure cross-linked polyethylene cable 27 in the pit, passes though vacuum interrupter 16 and disconnecting switch 20 and is fed from a high-pressure cross-linked polyethylene cable fitted at the top of the ceiling surface of the case 13 of the load-receiving board to the load side, via a load-dispatching board (not shown).

The $SF_6$ which fills interrupter cubicle 13*b,* load-receiving cubicle 13*c* and bus bar cubicle 13*d* has arc-extinguishing capability 100-fold and a insulating capability 3-fold that of air and it is this $SF_6$ gas that allows the case to be reduced in size.

Moreover, this is a colourless, odorless, tasteless gas with stable uninflammabity and it is also non-toxic. If, however, it is brought into contact with an arc, highly toxic degradation gases and degradation products such as $SOF_2$, $SO_2$, $SO_2F_2$, $SOF_4$, HF and $SiF_4$ are generated and special treatment and management are required to recover these degradation products and degradation gases from $SF_6$ gas.

In FIG. 1, of the switches incorporated into the load-receiving board, the vacuum interrupter 16 extinguishes the arc inside the vacuum valve, and Bo no degradation gases of $SF_6$ gas are generated but when in disconnecting switch 20, the loop current is interrupted when the circuit is switching or the bus-bar is switched within the insulating gas in the substation (transformer station), and arcing occurs, albeit less than with an accidental current.

Furthermore, $SF_4$ gas is a greenhouse effect gas and thus one of the causes of global warming, with a global warming index 24,000-fold that of carbon dioxide.

Because of this, at the Third Session of the Conference of the Parties to the United Nations Framework Convention on Climate Change (COP3), held in Kyoto, Japan in December 1997, $SF_6$ gas was added to the gases to be reduced and there was demand for emissions to be limited.

Vacuum has been therefore considered as an insulating medium for interrupters but there are large variations in the insulating capability of vacuum.

If these variations are expressed as standard deviations, that of $SF_6$ gas is 6–7%, whereas that of vacuum is 10–13% and this may be increased in switch conditions to reach 18%.

Moreover, since, in terms of the safety of power circuits, there is a strong requirement for the insulation of interrupters to be reliable and thus a requirement for the development of an interrupter in which the insulation reliability of the vacuum atmosphere of the prior art is further improved.

SUMMARY OF THE INVENTION

Accordingly, one object of the present invention is to provide a vacuum switch capable of meeting the demands for improvement in environmental protection and insulation reliability.

In order to achieve the above object, the present invention has the following structure. Namely, it is a vacuum switch fitted with a vacuum valve having an insulation tube to both ends of which is fitted an end cap;

a fixed-side conductive rod, which is fitted loosely into one side of the said insulation tube and the base of which is fixed to the said end-plate and to the tip of which is fixed the fixed-side contact: and a movable-side conductive rod which is fitted loosely into the other said end-plate via a bellows and to the tip of which is fitted the movable-side contact;

the vacuum switch comprising:

a circular third electrode fitted coaxially at the intermediate part of the inner periphery of the said insulation tube, opposite the said fixed-aide contact and the said movable-side contact.

By these means, in the present invention, any arc generated when the contact is opened is led through the two gaps formed linearly between the third electrode and the fixed-side contact and moveable-side contact and this reduces the differences in interruption characteristics caused by differences in dielectric breakdown voltage.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
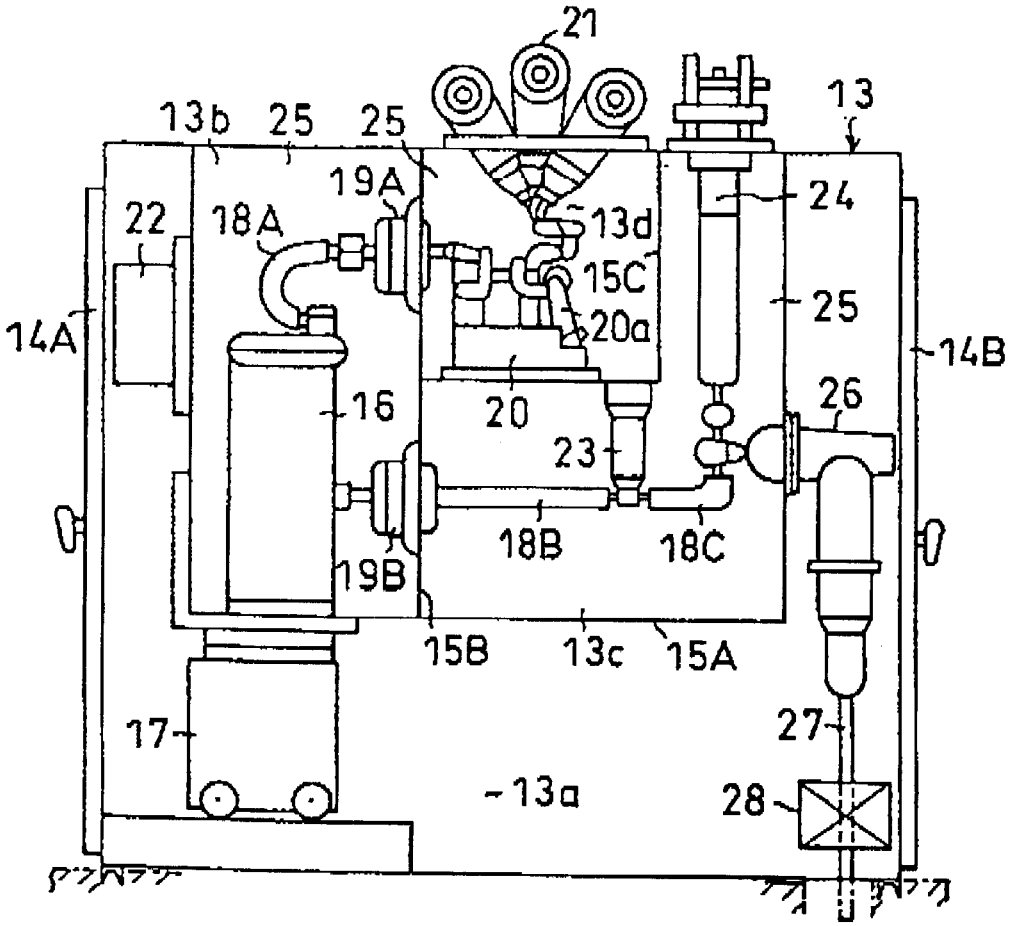
FIG. 1 ( PRIOR ART )
FIG. 1 is one example of a cubicle-type gas-insulated switchgear shown as an example of the vacuum switches of the prior art.

Referring now to the drawings, wherein like reference numerals designate identical or corresponding parts throughout the several views, and more particularly to FIG. 2 thereof, one embodiment of the present invention will be described.

Figure 2:
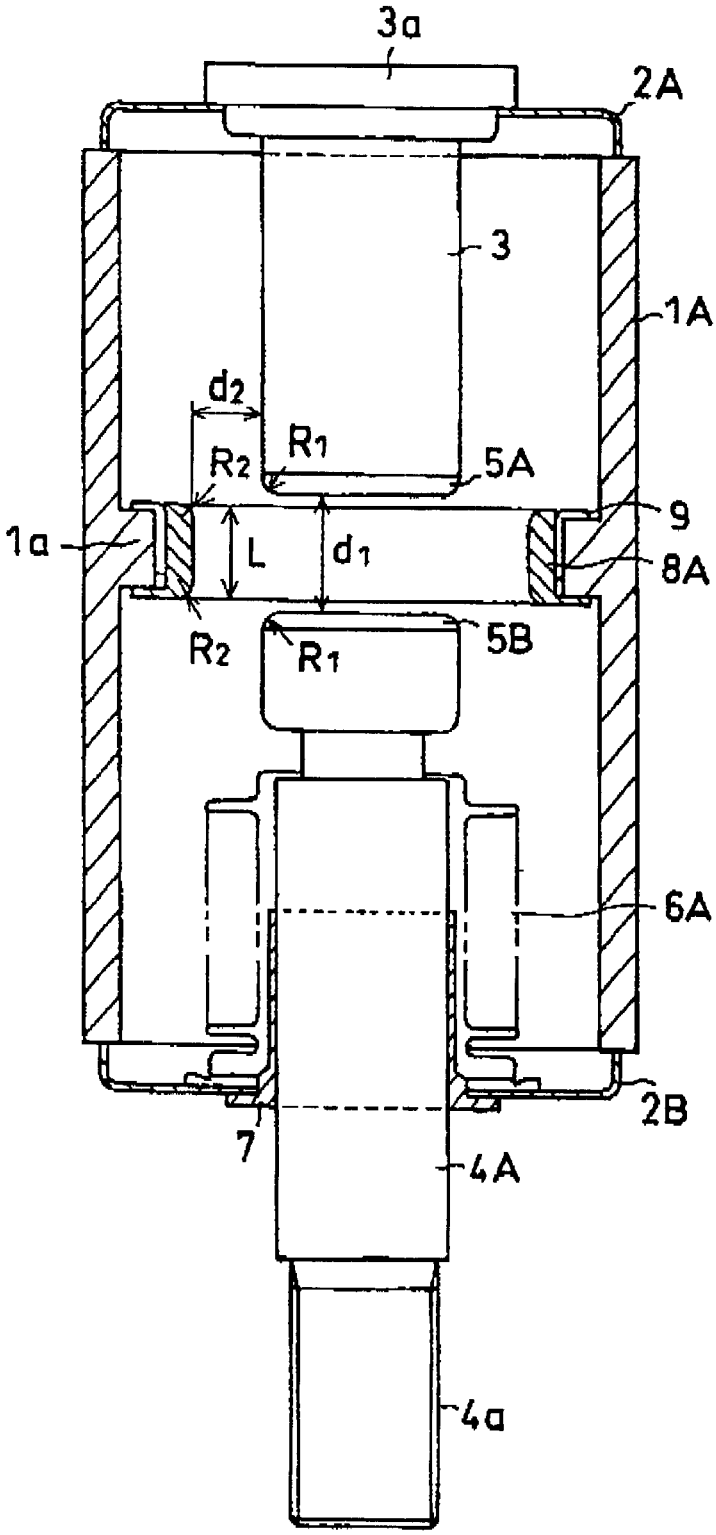
FIG. 2 shows a vertical cross-section of the first embodiment of the vacuum switch according to the invention.

FIG. 2, a vertical cross-section of the first embodiment of the vacuum switch according to the present invention, shows it in interrupted status.

The vacuum valve shown in FIG. 2, which is a vacuum valve for use as a circuit disconnecting switch, is of the same structure as vacuum valves of the prior art. It differs, however, in that it has a third electrode, as described below, at the central part of the inner surface of the insulation container and is so structured that the strength of the electrical field between this electrode and the fixed-side contact and movable-side contact fulfils the conditions described below.

That is, as in the case of the vacuum valves of the prior art, fixed-side end-place 2A is soldered onto the top end, as in FIG. 2, of insulating tube 1A which is a ceramic substance formed into a tube, and movable-side end-plate 2B, of approximately the same shape, is soldered symmetrically onto the bottom end of insulating tube 1A.

Of these, and similarly to a vacuum valve of the prior art, the fixed-side conducting rod 3 is linked from above to fixed-side end-plate 2A and the lower surface of the outer periphery of top end flange part 3*a* is attached to the outer surface of fixed-side end-plate 2A.

On the other hand, bush 7 is inserted from below into movable-side end-plate 2B, movable-side conductive rod 4A is inserted into bush 7 and the top end of bellows 6A, which is fitted loosely into the exterior side of bush 7, is soldered in an air-tight manner to the exterior surface of bush 7 and the bottom end of bellows 6A is soldered in an airtight manner to the interior surface of end-plate 2B.

A copper-tungsten alloy or copper-chromium alloy fixed-side contact 5A is soldered to the bottom end of fixed-side conductive rod 5A and movable-side contacts of the materials described below are each soldered to the top end of movable-side conductive rod 4A.

Male screw 4*a* is worked into the exterior periphery of the bottom of movable-side conductive rod 4A and is linked to the top end of the output-side insulated operating rod of the operating mechanism (not shown) incorporated to the vacuum switch.

At the center of the inner periphery of insulating tube 1A, a part of the insulating tube 1A is formed into a projecting support part 1*a,* protuberant in cross-section, and support fitting 9, which is circular and has an L-shaped partial cross-section, is also soldered to support part 1*a*.

In the above description, the structure is approximately the same as that of a vacuum valve of the prior art, except in that there is no shield plate. However, a vacuum valve that is the vacuum switch according to the invention may be such that a third electrode 8A, which is circular and which has an approximately L-shaped partial vertical cross-section and is made of any of the materials described below, is inserted into and soldered to the inner peripheral surface of support fitting 9.

Thus, the material of third electrode 8A is manufactured from a copper-tungsten alloy or copper-chromium alloy and, as shown in FIG. 2, the relationship between the gap $d_2$, between the outer periphery of the contacts and the inner periphery of third electrode 8A, and the gap $d_1$, between the contacts, is $d_2=(0.4–0.8)d_1$.

Also, when the radius of curvature of the arc-shaped chamfered part of the outer peripheries of movable-side contact 5B and fixed-side contact 5A is $R_1$ then $R_1=(0.1–0.4)d_1$ and when the radius of curvature of the arc-shaped chamfered part of the third electrode 8A that faces movable-side contact 5B and fixed-side contact 5A is $R_2$ then the relationship between radii of curvature $R_1$ and $R_2$ is $R_2=(1.2–2.0)R_1$.

Furthermore, when the axial width of third electrode 8A is L and the gap between fixed-side contact 5A and movable-side contact 5B is $d_1$, then the relationship between the width of third electrode 8A (L) and gap $d_1$ is $L=(0.6–0.95)d_1$.

Figure 3:
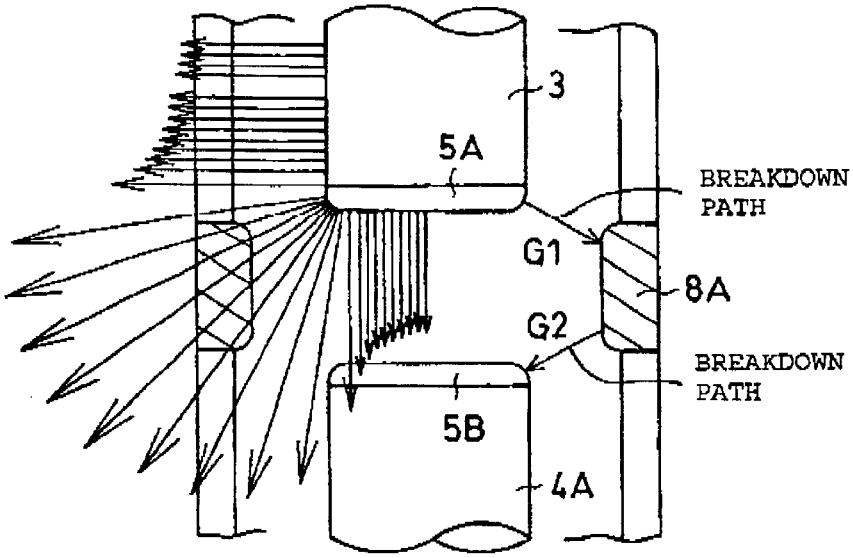
FIG. 3 is an explanatory diagram showing the actions of Embodiment 1 of the vacuum switch according to the invention.

When a vacuum valve is configured with these mutual relationships between the third electrode, fixed-side contact and movable-side contact, the distribution of the strengths of electrical fields between the contacts and between the contacts and third electrode, when the contact is open, are as shown in FIG. 3.

In this figure, the length of the arrows indicates the strength of the electrical field.

As, when there is dielectric breakdown the electrical field strength of the end of fixed-side contact 5A is high, it is generated first at gap $G_1$, between fixed-side contact 5A and third electrode 8A, and then all the impressed voltage is impressed on gap $G_2$, between the inner periphery of the bottom end of third electrode 8A and the outer periphery of movable-side electrode 5B, and insulation fails in this gap $G_2$.

Generally, the probability of dielectric breakdown of a vacuum gap can be expressed by a Weibull distribution function and the cumulative probability of breakdown F (V) is expressed by the following expression.

$$F(V)=1-\exp[-\{(V-V_0)/V_1\}^m] \quad (1)$$

Here, $V_1$ is the dimensional parameter, m is the shape parameter and $V_0$ is the location parameter and it shows the voltage at which the breakdown probability is zero when $V \leqq V_0$.

Therefore, if the impressed voltage is V, the voltage impressed on gap $G_1$, between the third electrode and fixed-side contact 5A, is V/2 and the breakdown probability of gap $G_1$ is f(V/2), and the breakdown probability of gap $G_2$ is f (V) then the dielectric breakdown probability of the two locations $G_1$ and $G_2$, as shown in FIG. 3, is expressed by the following expression.

$$F(V)=f(V/2)*f(V) \quad (2)$$

Figure 4:
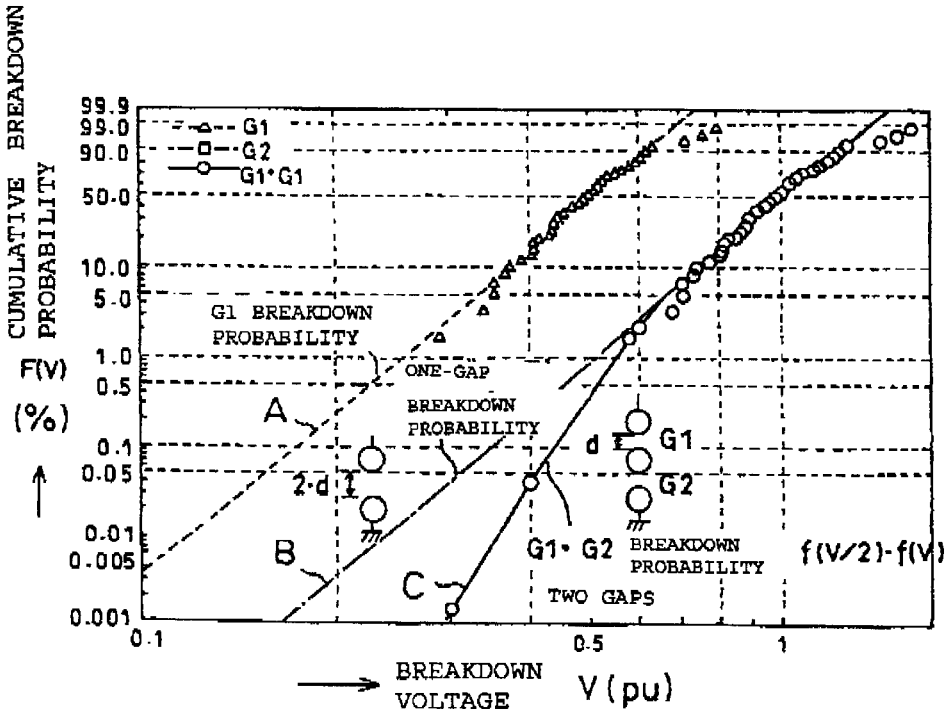
FIG. 4 is a graph showing the actions of the first embodiment of the vacuum switch according to the invention.

FIG. 4 is a graph showing the dielectric breakdown probability for lightning impulse voltage; the present inventors investigated the dielectric breakdown characteristics of one gap and two gaps and this graph shows a comparison of the cumulative breakdown probability of these expressed as a Weibull plot.

As shown by a comparison between the plot for breakdown probability with one gap, shown as a dot-dash line B in FIG. 4 and the two gap breakdown probability, shown as a solid line C, it is possible to reduce the breakdown probability at low voltages to lower than for one gap by providing a third electrode 8A and having two gaps formed linearly, although there is no such reduction at high voltages, where the plots overlap.

Therefore, it is possible to increase the insulation reliability of a vacuum disconnecting switch which uses a vacuum as the insulation medium.

Third electrode 8A, which is attached to a protuberance 1*a* on the inner surface of the insulating tube 1A, has a simple and readily-manufactured shape so that the provision of third electrode 8A does not result in any problems in terms of manufacture or cost.

Figure 5:
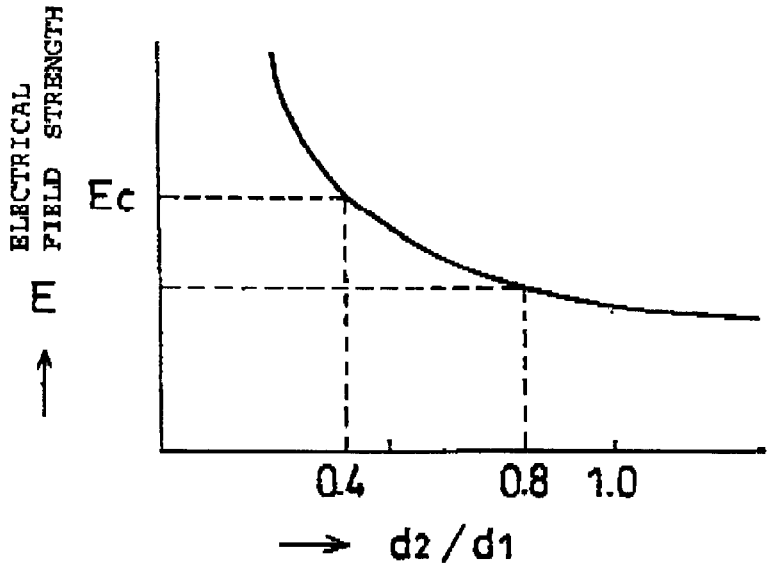
FIG. 5 is a graph showing actions, other than those in FIG. 4, of the first embodiment of the vacuum switch according to the invention.

FIG. 5 is a graph showing the relationship between the ratio $d_2/d_1$ and the strength of the electrical field of the outer periphery of the end of fixed-side contact 5A, when the gap between fixed-side contact 5A and movable-side contact tB is $d_1$ and the gap between the inner periphery of third electrode 8A and the outer peripheries of fixed-side contact 5A and movable-side contact 5B is $d_2$.

The strength of the electrical field of the end of fixed-side contact 5A decreases, and is almost completely saturated when the ratio $d_2/d_1$ is 0.8 or greater. Since the outer diameter of the disconnecting switch vacuum valve increases when the ratio $d_2/d_1$ is increased, it is preferable both in terms of economy and of practicality that the ratio $d_2/d_1$ should be kept as small as possible.

Also, the electrical field strength increases as the ratio $d_2/d_1$ decreases, reaching the breakdown voltage strength of copper $E_c$ when the ratio $d_2/d_1$ is 0.4.

It is therefore possible to obtain a disconnecting switch vacuum valve with excellent insulation reliability without greatly increasing the exterior diameter of the interrupter vacuum valve by keeping the ratio $d_2/d_1$ within the range 0.4–0.8.

Figure 6:
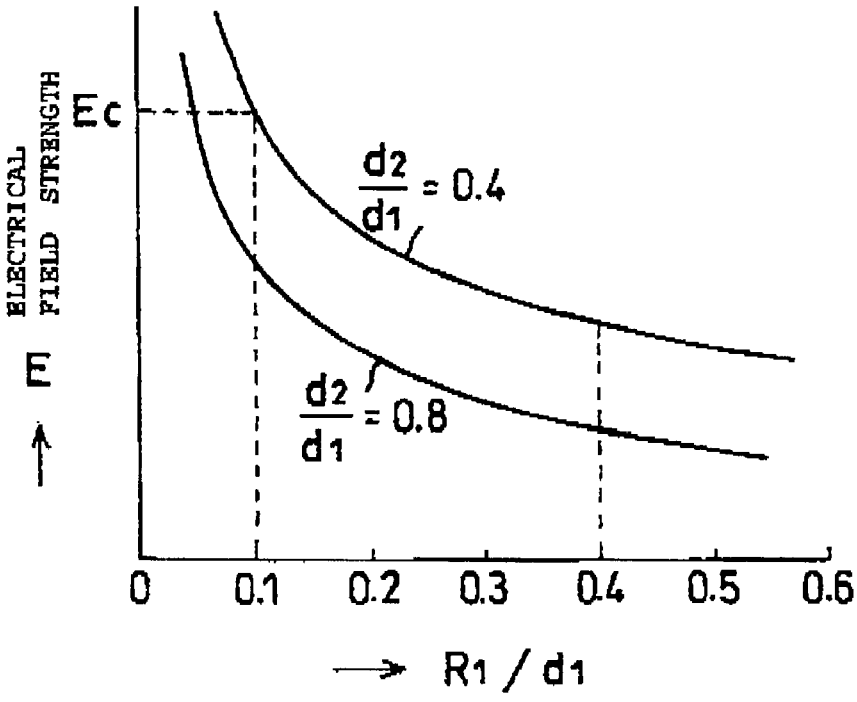
FIG. 6 is a graph showing actions, other than those in FIGS. 4 and 5, of the first embodiment of the vacuum switch according to the invention.

FIG. 6 is a graph showing the relationship between the electrical field strength of the outer periphery of the fixed-side contact 5A and the ratio $R_1/d_1$ when the gap between fixed-side contact 5A and movable-side contact 5B is $d_1$ and the radius of curvature of the arc-shaped chamfered part of the outer peripheries of movable-side contact 5B and fixed-side contact 5A is $R_1$.

The electrical field strength of the outer periphery of the fixed-side contact 5A varies according to the ratio $R_1/d_1$ as described above, and, as shown in FIG. 6, if the ratio $R_1/d_1$ becomes 0.4 or greater, this decreases and is almost completely saturated.

As the ratio $R_1/d_1$ increases, the thickness of fixed-side contact 5A must increase and the coat also increase, so it is preferable for practicality that the ratio $R_1/d_1$ should be as small as possible.

Also, as the ratio $R_1/d_1$ decreases, the electrical field strength increases, when the ratio $d_2/d_1$ is 0.4, and the ratio $R_1/d_1$ is 0.1, the breakdown voltage strength of copper $E_c$ is reached.

Therefore, it is possible to keep down the price of a disconnecting switch vacuum valve and obtain a vacuum valve for a disconnecting switch which is practicable and has excellent insulation reliability, by keeping the ratio $R_1/d_1$ within the range 0.1–0.4.

Figure 7:
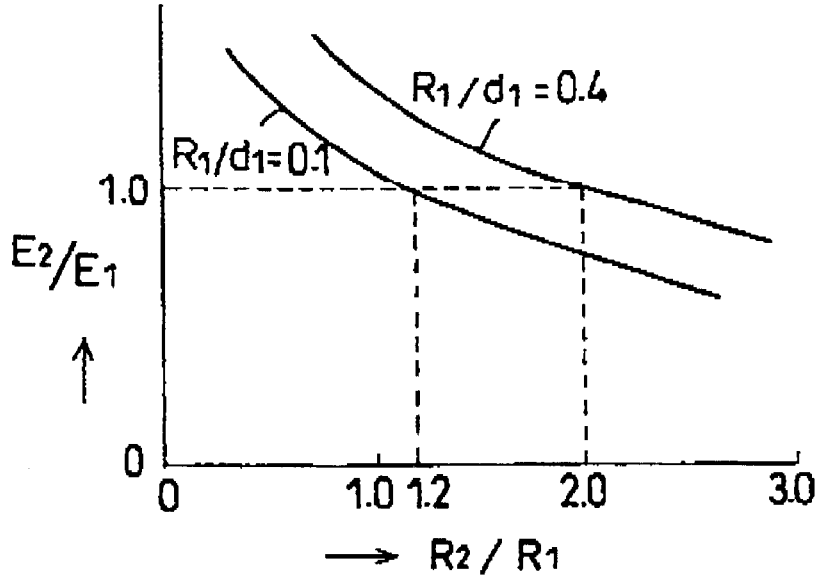
FIG. 7 is a graph showing actions, other than those in FIGS. 4, 5 and 6, of the first embodiment of the vacuum switch according to the invention.

FIG. 7 is a graph showing the relationship between radii of curvature ratio $R_2/R_1$ and the electrical field strength ratio $E_1/E_2$, when the radius of curvature of the peripheral arcuate chamfered parts of fixed-side contact 5A and movable-side contact 5B is $R_1$, the radius of curvature of the peripheral arcuate chamfered parts of the third electrode 8A that are opposite to fixed-side contact 5A and movable-side contact 5B is $R_2$ and the electrical field strength of the outer periphery of fixed-side contact 5A is $E_1$ and the electrical field strength of the third electrode 8A that faces the fixed-side terminal 5A is $E_2$.

More stable insulation reliability can be achieved if the electrical field strength of the outer periphery of fixed-side contact 5A ($E_1$) and the electrical field strength of the third electrode 8A that faces the fixed-side terminal 5A ($E_2$) are the same.

When the radius of curvature of the outer peripheral arcuate chamfered parts of movable-side contact 5B and fixed-side contact 5A is $R_1$, and the gap between fixed-side contact 5A and movable-side contact 5B is $d_1$, $R_1$ is within the range $R_1=(0.1–0.4)d_1$ and the relationship between curvature radii $R_1$ and $R_2$ such that $E_1$ and $E_2$ are the same is $R_2=(1.2–2.0)R_1$, as shown in FIG. 6.

By these means, it is possible to keep down the price of a vacuum valve disconnecting switch and obtain a vacuum valve for a disconnecting switch which is practicable and has excellent insulation reliability.

The present inventors tested the dielectric breakdown characteristics and breakdown routes by varying the value of L when the gap between fixed-side contact 5A and movable-side contact 5B is $d_1$ and the axial width of third electrode 8A is L. Therefore, measurements were taken to determined whether the dielectric breakdown was via the third electrode, as shown in FIG. 3.

Figure 8:
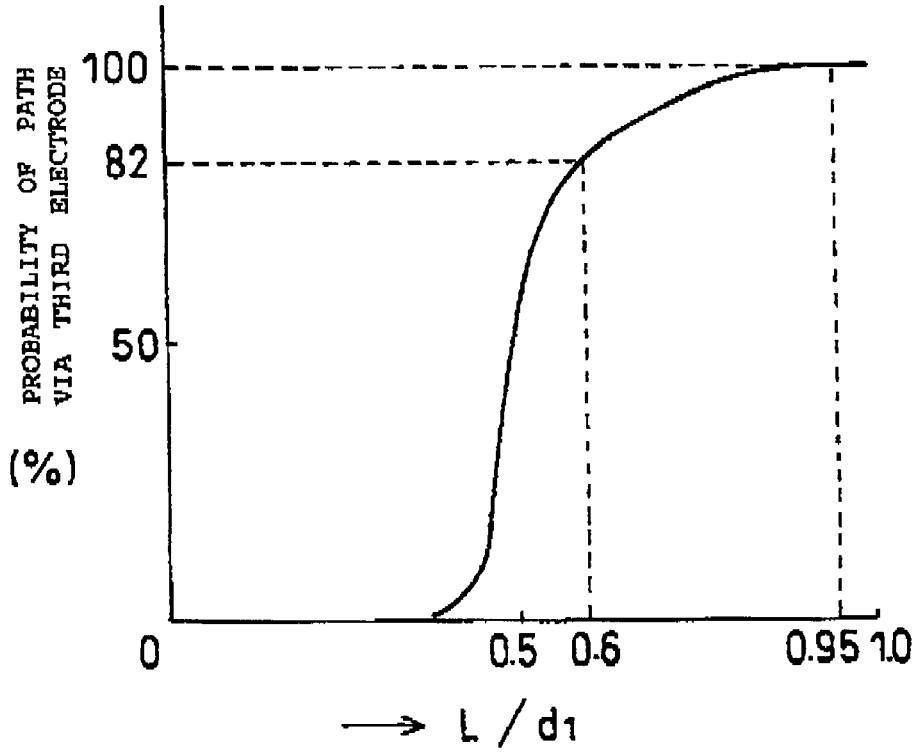
FIG. 8 is a graph showing actions, other than those in FIGS. 4, 5, 6 and 7, of the first embodiment of the vacuum switch according to the invention.

FIG. 8 is a graph showing the relationship $L/d_1$ and the probability of dielectric breakdown via the third electrode 8A. As shown in FIG. 8, when $L/d_1$ is 0.6 or lower, the probability that this is via the third electrode 8A decreases rapidly.

Also, when $L/d_1$ is 0.95 or higher, the probability that this is via the third electrode 8A is 100%. As stated above, when the breakdown route is via the third electrode 8A, there is a decrease in the breakdown probability at low voltage and the insulation reliability is increased.

Therefore, in order to improve the insulation reliability of vacuum disconnecting switches, it is preferable that the relationship between the width L of the third electrode 8A and gap $d_1$ should be $L=(0.6–0.95)d_1$.

Since, as a result of this, dielectric breakdown probabilities for the movable-side contact and fixed-side contact gaps are decreased at disconnection position and it is possible to move breakdown to $G_1$ and $G_2$, the insulation reliability as a disconnecting switch is increased.

Figure 9:
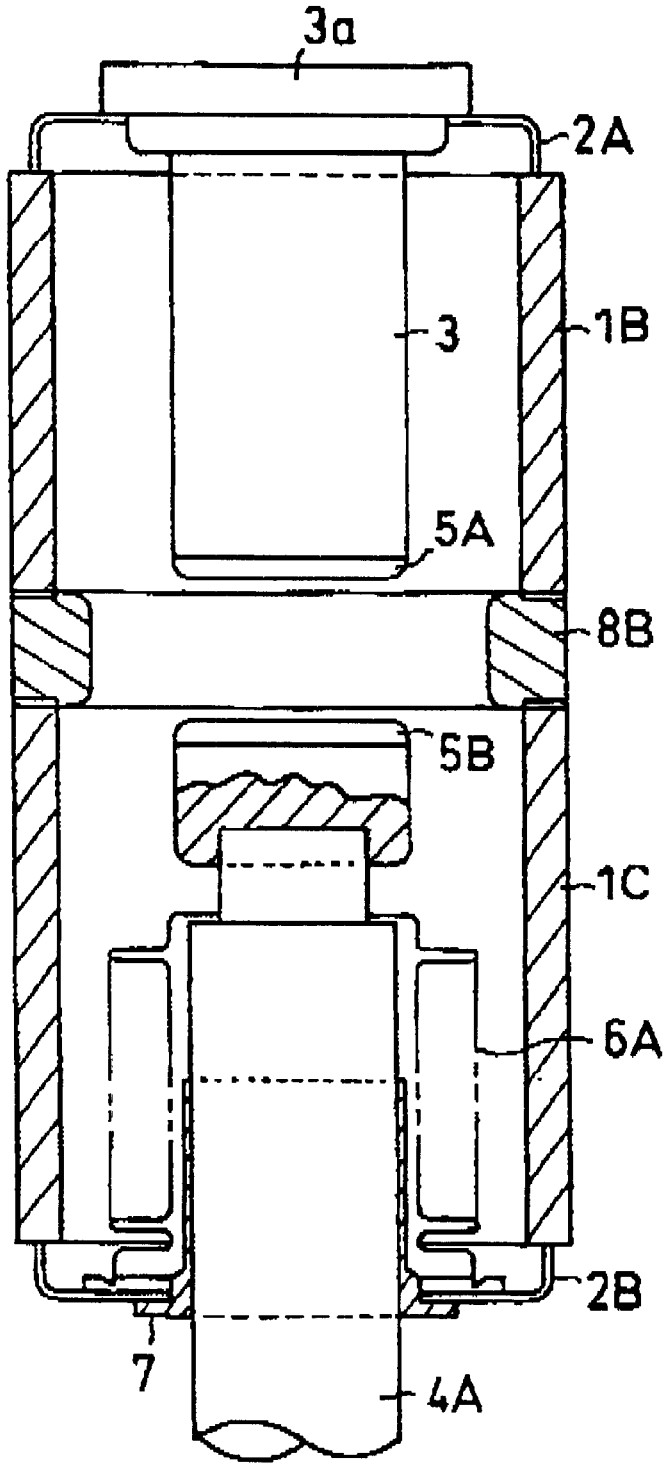
FIG. 9 shows a vertical cross-section of the second embodiment of the vacuum switch according to the invention.

FIG. 9 is a vertical cross-section showing a second embodiment of the vacuum switch according to the present invention of the application; this corresponds to the first embodiment shown in FIG. 2 and, in particular, shows a disconnected status similar to that in FIG. 2.

In FIG. 9, the elements that differ from the embodiment shown in FIG. 2 are that the insulated container is divided horizontally into an upper and lower part and the third electrode is inserted between the upper and lower insulated containers and the outer periphery is exposed. Otherwise this embodiment is identical with the embodiment shown in FIG. 2.

Therefore, the identifying numerals for the same elements are identical in each figure and not explained again here.

Thus, in the vacuum valve shown in FIG. 9, the insulating tube comprises an upper insulating tube 1B and lower insulating tube 1C, and the third electrode 8B is inserted and soldered between upper insulating tube 1B and lower insulating tube 1C.

In a vacuum valve thus constituted, it is possible carry out 'conditioning' processing at the final stage of manufacture by making one side of the third electrode 8B a terminal and impressing a high voltage onto the gap between third electrode 8B and fixed-side contact 5A (equivalent to $G_1$ in FIG. 3) and on the gap between third terminal 8B and movable-side contact 55 (equivalent to $G_2$ in FIG. 3).

Thus, generally, the insulation characteristics between electrodes in a vacuum may be subjected to a 'conditioning effect' in which the insulating properties between the electrodes are improved and stabilized each time a high voltage is impressed, instantaneously and repeatedly, between electrodes and dielectric breakdown caused.

Because of this, conditioning is carried out at the final stage of manufacture to prevent variations in dielectric breakdown voltage and, by using third electrode 8B as one of the terminals onto which the high voltage is impressed, variations in the insulation properties of gaps $G_1$ and $G_2$ are reduced.

It is also possible to reduce the exterior diameter of the vacuum valve since it is possible to avoid the formation of projecting support part 1*a*, as shown in FIG. 2, on the part of the inner periphery of the insulating tube opposite the contact.

Figure 10:
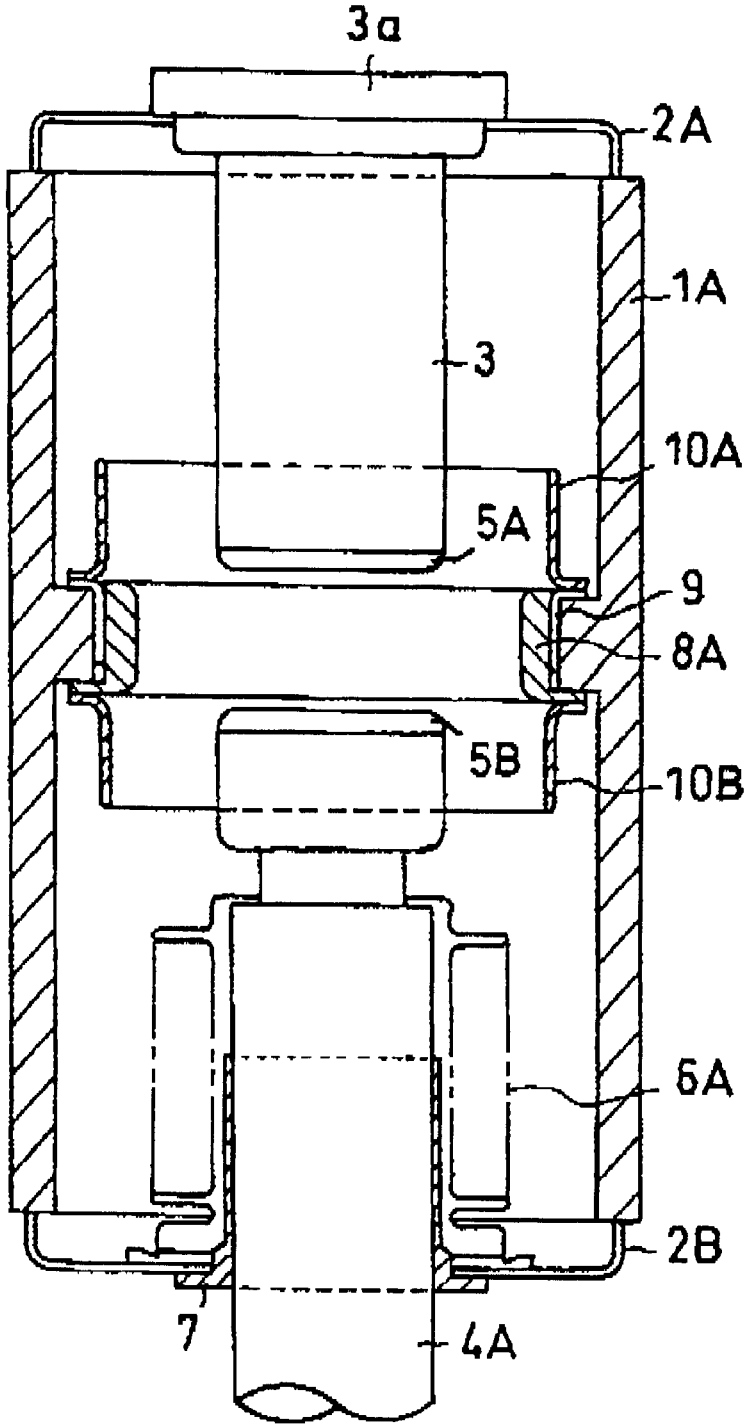
FIG. 10 shows a vertical cross-section of the third embodiment of the vacuum switch according to the invention.

FIG. 10, which is a vertical cross-section showing a third embodiment of the vacuum switch according to the invention, corresponds to FIG. 2 and FIG. 9, shows a disconnected status similar to that described above.

In FIG. 10, the parts that differ from the embodiments shown in FIG. 2 and FIG. 9 are that a shield plate is fixed above and below the third electrode, all other parts are identical with the first embodiment shown in FIG. 2 and the same elements as those shown in FIG. 2 are given the same identifying numerals and no description given here.

Thus, the curved edge of the bottom end of shield plate 10A, which is tubular and L-shaped in partial cross-section, is soldered onto the top end of support fitting 9, fixed to support part 1*a* formed at the center of the inner periphery of insulating tube 1A.

Similarly, the upper curved edge of a shield plate 10B, identical with the upper shield plate 10A, is soldered into place symmetrically.

Thus, in a vacuum valve incorporating shield plates 10A and 10B, the adhesion of metal vapour, produced by arcing between contacts when the current is disconnected, to the inner surface of the insulating tube is prevented and any deterioration of the insulating properties of the inner surface of the insulating tube is prevented.

Shield plates 10A and 10B may also be fitted to the vacuum valve shown as the second embodiment in FIG. 9.

Figure 11:
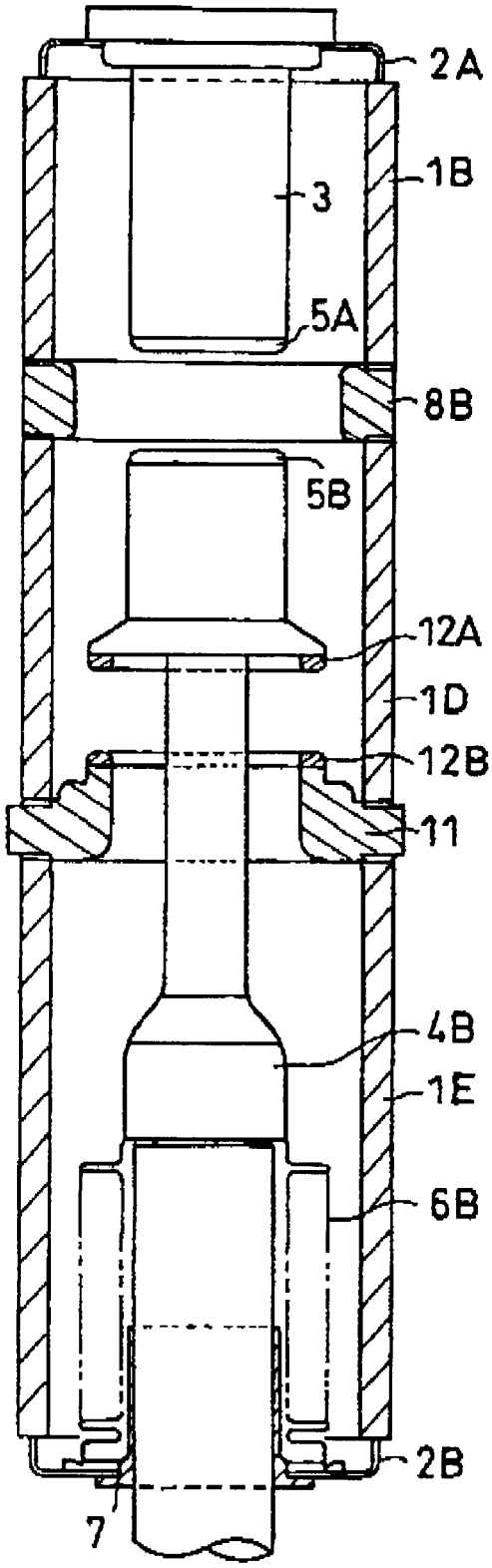
FIG. 11 shows a vertical cross-section of the fourth embodiment of the vacuum switch according to the invention.

Next. FIG. 11 is a vertical cross-section of a ninth embodiment of the vacuum switch according to the invention. This corresponds to FIG. 2, FIG. 9 and FIG. 10 and shows a disconnected status similar to that described above.

In FIG. 11, the part that differ from the embodiments shown in FIGS. 2, 9 and 10 is the addition of a function as earth interrupter; all other parts are almost completely identical with the embodiment shown in FIG. 1.

Because of space constraints, FIG. 11 is shown as smaller than FIGS. 2, 9 and 10.

Thus, this vacuum valve comprises an upper insulating tube 1B, a middle insulating tube 1D which is soldered, via third electrode 8B, to the bottom of this upper insulating tube 1B and a somewhat longer insulating tube 1E, soldered, via earth electrode 11, to the bottom of middle insulating tube 1D.

Of these, the earth electrode 11, which is soldered between middle insulating tube ID and lower insulating tube 1E, is fitted with a flange part soldered to upper insulating tube 1B and lower insulating tube 1E; this flange part is larger in diameter at the bottom and has a narrower middle part formed on top of this flange part and a narrower top part formed on top of this middle part.

Of these, the circular fixed-side earth contact 12B is soldered to the upper surface of the top part and the earth conductor, which is connected to the earth bus-bar of the case which encloses the vacuum switch, is also connected to the outer periphery of the earth electrode 11.

In the movable-side conductive rod 4B, the part which passes through the earth electrode 11, is narrower in diameter and a trapezoid flange part is formed at the lower edge of the head where the movable-side contact 5B is soldered and movable-side earth contact 12A is soldered onto the outer periphery underneath this flange part opposing the fixed-side earth contact 12B described above.

In vacuum switch in which the vacuum valve is thus constituted, the movable-side conductive rod 4B in the position shown in FIG. 11 is driven further downward, by the insulated operating rod (not shown) as described above, linked to the output end of the operating mechanism (not shown) incorporated in the vacuum switch, being driven further downward from the open position.

When this happens, the movable-side earth contact 12A comes into contact with the fixed-side earth contact 12B and the movable-side conductor (not shown), which is linked via a contact loop (not shown) to the bottom part of movable-side conductive rod 4B, is earthed continuously via the earth terminal 11 following the interruption action.

Therefore, in a vacuum switch into which a vacuum valve thus constituted is incorporated, it is possible to omit an earth disconnecting switch from the case containing the vacuum switch and possible reduce the exterior size of the case 13 shown as the prior art.

Further, in the embodiment described above, the material of third terminals 8A and 8B has been described as copper—tungsten alloy or copper—chromium alloy but, in applications where the current time is short or when carrying the excitation current for a transformer or the charge current for a condenser (capacitor), the fifth embodiment of the vacuum switch, which is inexpensive and where the material is stainless copper or tungsten, may be used.

Figure 12:
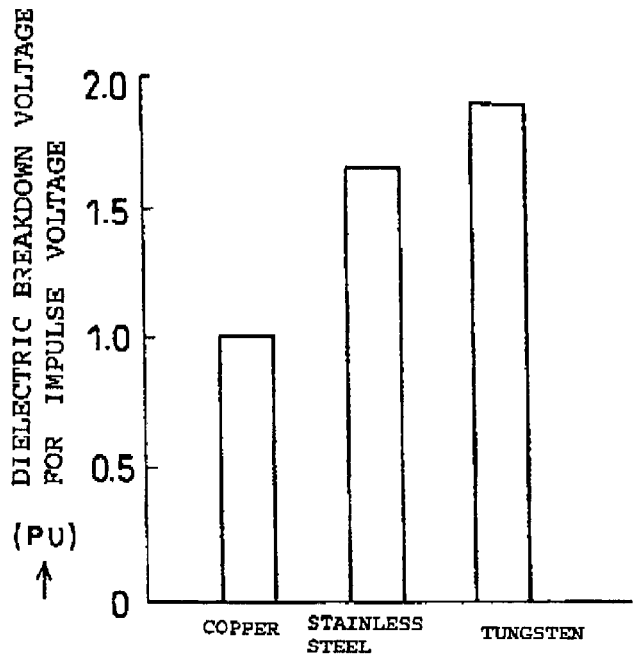
FIG. 12 is a graph showing the actions of the fifth embodiment of the vacuum switch according to the invention.

FIG. 12 is a bar graph showing the results of tests conducted by the present inventors in which the lightning impulse voltage insulation characteristics due to changes in the material of third electrode 8A are compared. The materials were copper (chlorine-free copper), stainless steel (SUS304) and tungsten.

The electrode used in these comparative tests were flat electrodes 34 mm in diameter and these electrodes were 1.5 mm apart. In FIG. 12, stainless steel was 1.7-fold and tungsten was 1.9-fold that of copper.

Third electrodes 8A and 8B of the type shown as the sixth embodiment in which the surface has been subjected to a electrochemical buffering treatment process and the conditioning time described above thus shortened.

Figure 13:
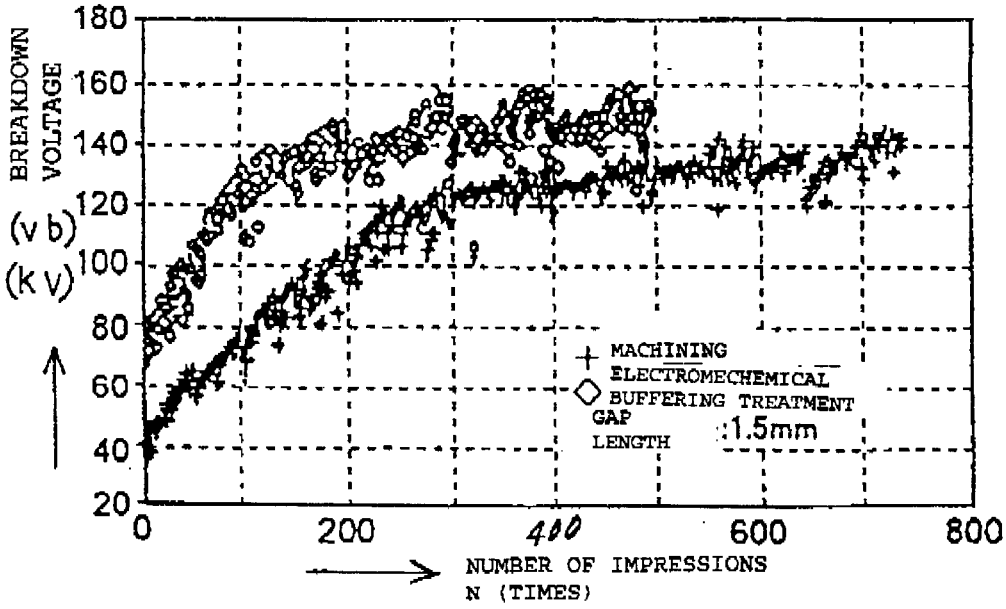
FIG. 13 is a graph showing the actions of the sixth embodiment of the vacuum switch according to the invention.

Thus, FIG. 13 is a graph showing a comparison of lightning impulse breakdown voltages due to differences in the surface state of the third electrode 8A.

The present inventors compared the lightning impulse voltage insulation characteristics of an electrode which had been finished by mechanical processing to a surface roughness of approximately 1 mm with those of an electrode which had been subjected to electrochemical buffering treatment. The electrolysis solution was a mixture of phosphoric acid and sulfuric acid.

Generally, as shown by the tests results in the graph in FIG. 13, the dielectric breakdown voltage in a vacuum grows higher as the dielectric breakdown is repeated. As stated above, this is known as the conditioning effect and the present inventors carried out this conditioning at the final stage of production stage of the vacuum valve.

As shown in FIG. 13, the upper group of electrodes subjected to complex electrolysis and grinding, shown by the symbol ◇, showed strong insulation properties after only a few impressions of voltage and the final breakdown voltage was approximately 20 kV higher than that of the lower group, shown by the symbol +, which had only been subjected to mechanical finishing.

Thus, by subjecting the surface of the electrode to electrochemical buffering treatment, it is not only possible to reduce the time required for conditioning but also to improve the insulation properties.

The seventh embodiment in which electron beam treatment is used as another method of reducing the time required for conditioning.

Figure 14:
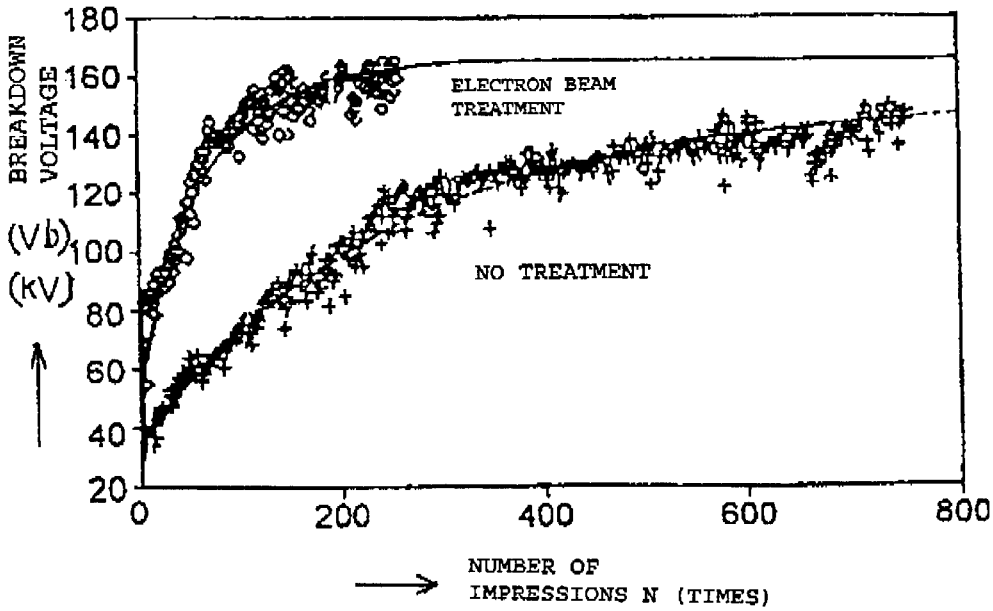
FIG. 14 is a graph showing the actions of the seventh embodiment of the vacuum switch according to the invention.

FIG. 14 is a graph showing a comparison of the voltage resistance of third electrode 8A when it had, and when it had not, been subjected to electron beam treatment. As shown in FIG. 14, the upper group of electrodes subjected to electron beam treatment, shown by the symbol ◇, showed strong insulation properties after only a few impressions of voltage and the final breakdown voltage was approximately 20 kV higher than that of the lower group, shown by the symbol +, which had not been subjected to electron beam treatment.

The device according to the present invention, is a vacuum switch fitted with a vacuum valve, comprising an insulating tube to both ends of which is fitted an end plate, a fixed-side conductive rod which is fitted loosely into one side of this insulating tube, the base of which is fixed to one end plate and the tip of which is fixed to the fixed-side contact, a movable-side conductive rod which is fitted through the end-plate to the end via a bellows and the tip is fitted into the movable-side contact, and a circular third electrode fitted coaxially in a central position of the inner periphery of the insulated tube and opposite the fixed-side contact and the movable-side contact and, furthermore according to the present invention, a protuberance is formed on the inner peripheral surface of the insulation tube and the third electrode is fixed to the inner periphery of this protuberance so that an arc generated when the contacts are opened is guided along the two gaps formed between the third electrode and the fixed-side contact and the movable-side contact, reducing the variations in interruption characteristics caused by variations in the dielectric breakdown voltage, resulting in the ability to meet requirements for protection of the environment and improvements in insulation reliability.

In the present invention, since the insulation tube is formed by a fixed-side insulating tube and movable-side insulation tube and a third electrode, the outer periphery of which is exposed, is provided between the fixed-side insulating tube and the movable-side insulation tube, and it is made possible to impress voltage for conditioning between the third electrode and mixed-side contact or the movable-side contact, it is possible to obtain a vacuum switch that meets the requirements for protection of the environment and improvements in insulation reliability.

Furthermore, in the present invention, since, if the gap between the fixed-side contact and movable-side contact is $d_1$, one half of the difference between the exterior diameter of the inner radius of the third electrode and outer diameter of the fixed-side contact and movable-side contact is $d_2$, the radius of curvature of the chamfered part of the outer periphery of the facing sides of the fixed-side contact and movable-side contact is $R_1$, the radius of curvature of the chamfered part of the other ends of the inner periphery of the third electrode is $R_2$ and the width of the third electrode in the axial direction is L, then $d_2=(0.4–0.8)d_1$, $R_1=(0.1–0.4)d_1$, $R_2=(1.2–2.0)R_1$ and $L=(0.6–0.95)d_1$, the electrical field strength between the contacts is restricted without any increase in the thickness of the fixed-side contact or movable-side contact and also the probability that an arc generated when the switch opens will follow a path via the third electrodes is increased, it is possible to obtain a vacuum switch that meets the requirements for protection of the environment and improvements in insulation reliability.

Furthermore, in the present invention, since any decrease in insulation properties caused by the adhesion of metal vapour produced when the switch is opened to the inner surface of the insulation tube is prevented by fixing a shield plate to the fixed-side contact and movable-side contact on both sides of, and on the same axis as, the third electrode, it is possible to obtain a vacuum switch that meets the requirements for protection of the environment and improvements in insulation reliability.

Furthermore, in the present invention, since the outer periphery of the earth electrode, into which the movable-side conductive rod is fitted loosely, is exposed in the middle part of the insulation tube, the earth contact part which is brought into contact with the earth electrode by the earthing action which follows the interruption action of the movable conductive rod, is formed by a movable conductive rod and the function of earthed interruption is thus added through contact with the earth contact part of the earth electrode, it is possible to obtain a vacuum switch that meets the requirements for protection of the environment and improvements in insulation reliability.

Obviously, numerous additional modifications and variations of the present invention are possible in light of the above teachings. It is therefore to be understood that within the scope of the appended claims, the present invention may be practiced otherwise than as specially described herein.

What is claimed is:

1. A vacuum switch fitted with a vacuum valve comprising:

an insulation tube to both ends of which is fitted an end plate;

a fixed-side conductive rod, which is fitted loosely into one side of said insulation tube and a base of which is fixed to a first end plate and a fixed-side contact fixed to a tip of said fixed-side conductive rod;

a moveable-side conductive rod which is fitted loosely into a second end-plate via a bellows;

a movable-side contact fixed to a top of said movable-side conductive rod, wherein an outer periphery of said movable-side contact faces an outer periphery of said fixed-side contact; and a circular third electrode, fitted coaxially at an intermediate part of an inner periphery of said insulation tube, an inner periphery of said circular third electrode between and facing said fixed-side contact and said movable-side contact, wherein when a gap between said fixed-side contact and movable-side contact is $d_1$, one half of a difference between an inner radius of said third electrode and outer diameter of said fixed-side contact and said movable-side contact is $d_2$, a radius of curvature of a chamfered part of an outer periphery of facing sides of said fixed-side contact and movable-side contact is $R_1$, a radius of curvature of said chamfered part of other ends of and inner periphery of said third electrode is $R_2$ and a width of said third electrode in an axial direction is L, then $$d_2=(0.4\sim0.8)d_1$$

$$R_1=(0.1\sim0.4)d_1$$

$$R_2=(1.2\sim2.0)R_1$$

$$L=(0.6\sim0.95)d_1.$$

2. The vacuum switch, according to claim 1, wherein a protuberance is formed on an inner periphery of said insulation tube and said third electrode is fitted on an inner periphery of said protuberance.

3. A vacuum switch fitted with a vacuum valve, comprising:

an insulation tube to both ends of which is fitted an end plate;

a fixed-side conductive rod, which is fitted loosely into one side of said insulation tube and a base of which is fixed to a first end plate and a fixed-side contact fixed to a tip of said fixed-side conductive rod;

a moveable-side conductive rod which is fitted loosely into a second end-plate via a bellows;

a movable-side contact fixed to a tip of said movable-side conductive rod, wherein an outer periphery of said movable-side contact faces an outer periphery of said fixed-side contact; and a third electrode fitted with an outer periphery exposed between a fixed-side insulation tube and a movable-side insulation tube, wherein said insulation tube is formed from a fixed-side insulation tube and movable-side insulation tube, wherein when a gap between said fixed-side contact and movable-side contact is $d_1$, one half of a difference between an inner radius of said third electrode and outer diameter of said fixed-side contact and said movable-side contact is $d_2$, a radius of curvature of a chamfered part of an outer periphery of facing sides of said fixed-side contact and movable-side contact is $R_1$, a radius of curvature of said chamfered part of other ends of and inner periphery of said third electrode is $R_2$ and a width of said third electrode in an axial direction is L, then $$d_2=(0.4\sim0.8)d_1$$

$$R_1=(0.1\sim0.4)d_1$$

$$R_2=(1.2\sim2.0)R_1$$

$$L=(0.6\sim0.95)d_1.$$

4. The vacuum switch according to claim 1, 2, or 3, further comprising:

a shield plate configured to cover said fixed-side contact and movable-side contact on both sides in a direction in the same axis as said electrode;

an earth electrode fitted with an outer perimeter, being exposed such that said movable-side conductive rod is fitted loosely in an intermediate part of said insulation tube; and an earth contact part which is brought into contact with said earth electrode on said movable-side conductive rod by an earthing action which follows an interruption action of said movable-side conductive rod.

5. The vacuum switch, according to claim 1, 2, or 3, further comprising:

a shield plate fixed so as to cover said fixed-side contact and movable-side contact on both sides in a direction in the same axis as said third electrode.

6. The vacuum switch according to claim 1, 2, or 3, further comprising:

an earth electrode fitted with an outer perimeter, being exposed such that said movable-side conductive rod is fitted loosely in an intermediate part of said insulation tube; and an earth contact part which is brought into contact with said earth electrode on said movable-side conductive rod by an earthing action which follows an interruption action of said movable-side conductive rod.

* * * * *

UNITED STATES PATENT AND TRADEMARK OFFICE

CERTIFICATE OF CORRECTION

PATENT NO. : 6,476,338 B2
DATED : November 5, 2002
INVENTOR(S) : Shioiri et al.

It is certified that error appears in the above-identified patent and that said Letters Patent is hereby corrected as shown below:

Title page,
Item [57], delete the ABSTRACT in its entirety and replace with the following:

-- A vacuum switch is fitted with a vacuum valve having an insulation tube, both ends of which are fitted with end plates. The vacuum switch also has a fixed-side conductive rod, which is fitted loosely into one side of the insulation tube and a base which is fixed to an end plate. A fixed-side contact is fixed to a tip of the fixed-side conductive rod. The vacuum switch also has a movable-side conductive rod which is fitted loosely into the other end plate via a bellows and has a moveable-side contact fixed to a tip of the movable-side conducting rod. A circular third electrode is fitted coaxially at an intermediate part of an inner periphery of the insulation tube with an inner periphery of the circular third electrode facing and between the fixed-side contact and the movable-side contact. --.

Signed and Sealed this

Sixth Day of May, 2003

JAMES E. ROGAN
*Director of the United States Patent and Trademark Office*